US009140114B2

(12) United States Patent
Perrin et al.

(10) Patent No.: US 9,140,114 B2
(45) Date of Patent: Sep. 22, 2015

(54) INSTRUMENTED DRILLING SYSTEM

(75) Inventors: Cedric Perrin, Forcelles Saint Gorgon (FR); Christopher C. Bogath, Gloucestershire (GB); Michael Pearce, Gloucestershire (GB); Oleg Polyntsev, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 477 days.

(21) Appl. No.: 13/529,988

(22) Filed: Jun. 21, 2012

(65) Prior Publication Data

US 2013/0341095 A1 Dec. 26, 2013

(51) Int. Cl.
*E21B 47/01* (2012.01)
*E21B 7/06* (2006.01)

(52) U.S. Cl.
CPC ..... *E21B 47/01* (2013.01); *E21B 7/062* (2013.01)

(58) Field of Classification Search
CPC ..... E21B 7/062; E21B 47/01; E21B 47/12; E21B 47/024
See application file for complete search history.

(56) References Cited

U.S. PATENT DOCUMENTS

| | | | | |
|---|---|---|---|---|
| 5,113,953 | A | 5/1992 | Noble | |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,085 | A | 10/1999 | Colebrook | |
| 6,089,332 | A | 7/2000 | Barr et al. | |
| 6,092,610 | A * | 7/2000 | Kosmala et al. | 175/61 |
| 6,142,228 | A * | 11/2000 | Jogi et al. | 166/250.01 |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 7,779,933 | B2 * | 8/2010 | Sihler et al. | 175/61 |
| 7,975,780 | B2 * | 7/2011 | Siher et al. | 175/57 |
| 2001/0052428 | A1 | 12/2001 | Larronde et al. | |
| 2002/0011359 | A1 | 1/2002 | Webb et al. | |
| 2005/0098350 | A1 | 5/2005 | Ippink et al. | |
| 2008/0149394 | A1 | 6/2008 | Downton | |
| 2010/0139980 | A1 | 6/2010 | Neves et al. | |
| 2011/0042144 | A1 | 2/2011 | Downton | |
| 2011/0308858 | A1 | 12/2011 | Menger et al. | |
| 2012/0031677 | A1 * | 2/2012 | Schulte et al. | 175/61 |

* cited by examiner

*Primary Examiner* — Yong-Suk (Philip) Ro
(74) *Attorney, Agent, or Firm* — Chadwick A. Sullivan; Wesley Noah

(57) ABSTRACT

A technique facilitates drilling of wellbores or other types of bore holes in a variety of applications. A steerable system is designed with a main shaft coupled to a drill bit shaft by a universal joint to provide steering functionality. A sensor system is mounted on the steerable system and comprises at least one sensor positioned to measure desired parameters, such as weight on bit and/or torque on bit parameters during drilling.

8 Claims, 6 Drawing Sheets

FIG. 5
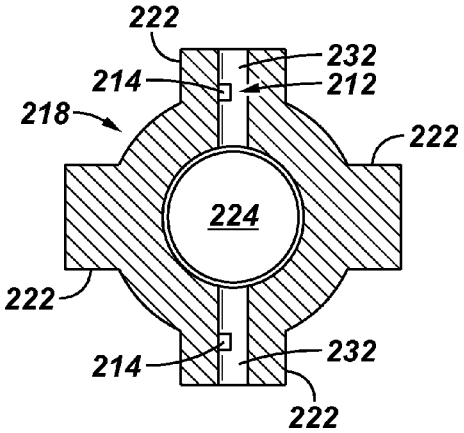
FIG. 6
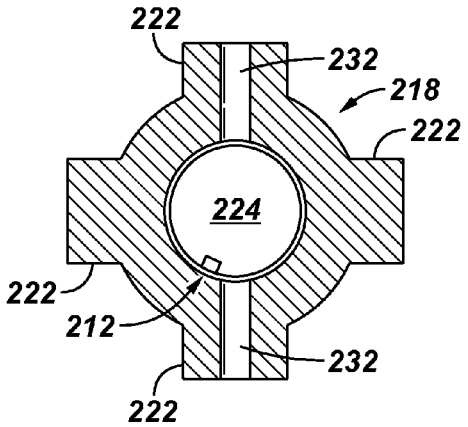
FIG. 7
| | MAX WOB MEASUREMENT 60,000 lbf | | | | MAX TOB MEASUREMENT 16,000 ft.lbf | | | |
|---|---|---|---|---|---|---|---|---|
| | STRAIN (με) | SENSITIVITY | X-READING DUE TO | | STRAIN (με) | SENSITIVITY | X-READING DUE TO | |
| | | | TOB | PRESSURE | | | TOB | PRESSURE |
| OPTION #1a | 1,600 | 37.5 lbf/με<br>26.7 με/Klbf | 19% | 0% | 1,500 | 10.7 (lbf.ft)/με<br>93.8 με/(Klbf.ft) | 27% | 0% |
| OPTION #1b | 1,000 | 60.0 lbf/με<br>16.7 με/Klbf | 50% | 28% | 1,200 | 13.3 (lbf.ft)/με<br>75.0 με/(Klbf.ft) | 75% | 23% |
| OPTION #2 | 800 | 75.0 lbf/με<br>13.3 με/Klbf | 6% | 0% | 600 | 26.7 (lbf.ft)/με<br>37.5 με/(Klbf.ft) | 92% | 46% |

INSTRUMENTED DRILLING SYSTEM

BACKGROUND

Hydrocarbon fluids such as oil and natural gas are obtained from a subterranean geologic formation, referred to as reservoir, by drilling a well that penetrates the hydrocarbon-bearing formation. Controlled steering or directional drilling techniques are used in the oil, water, and gas industry to reach resources that are not located directly below a wellhead. A variety of steerable systems have been employed to provide control over the direction of drilling when preparing a wellbore or a series of wellbores having doglegs or other types of deviated wellbore sections.

SUMMARY

In general, the present disclosure provides a system and method for drilling of wellbores or other types of bore holes in a variety of applications. A steerable system is designed with a main shaft coupled to a drill bit shaft by a universal joint. A sensor system is mounted on the steerable system and comprises at least one sensor positioned to measure desired parameters, such as weight on bit and/or torque on bit parameters during drilling.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 5 is a cross-sectional view of the cross member with instrumentation, according to an embodiment of the disclosure;

FIG. 6 is another cross-sectional view of the cross member with a different instrumentation arrangement, according to an embodiment of the disclosure;

FIG. 7 is a table summarizing strain measurements due to strain acting on the universal joint of the steerable system, according to an embodiment of the disclosure;

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to steerable systems which may be used to enable directional drilling of bore holes, such as wellbores. The system and methodology combine instrumentation with the steerable system to provide information on the drilling operation. By way of example, the steerable system may comprise a main shaft coupled to an output shaft, e.g., a drill bit shaft, by a universal joint; and instrumentation may be combined with the universal joint and/or other components of the steerable system to provide data on desired parameters. In some applications, the instrumentation may be used to help evaluate parameters such as weight on bit and torque on bit. The instrumentation also may be arranged to detect lateral forces acting on, for example, the universal joint. These various measurements may be taken via sensors mounted on the main shaft, the output shaft, and/or the universal joint connecting the main shaft and the output shaft. To facilitate selection of suitable sensors, the sensor or sensors may be placed on a corresponding component and encapsulated in oil to avoid any contamination from the environment, e.g., from drilling mud.

In some drilling applications, the weight on bit and torque on bit parameters may be measured in real time. Depending on borehole conditions, the instrumentation system may be self-compensated or calibrated against the effects of downhole parameters, such as pressure and temperature. For directional drilling applications, the tilt angle of the steerable system may be measured in real time to derive the tool face. For example, the instrumentation system may be used on a rotary steerable system tool to continually monitor the tilt angle of the rotary steerable system tool while drilling a deviated borehole.

The steerable system described herein is useful in a variety of drilling applications in both well and non-well environments and applications. For example, the instrumented steerable system can facilitate drilling of bore holes through earth formations and through a variety of other earth materials to create many types of passages. In well related applications, the instrumented steerable drilling system can be used to facilitate directional drilling for forming a variety of deviated wellbores. An example of a well system incorporating the instrumented steerable drilling system is illustrated in FIG. 1.

Figure 1:
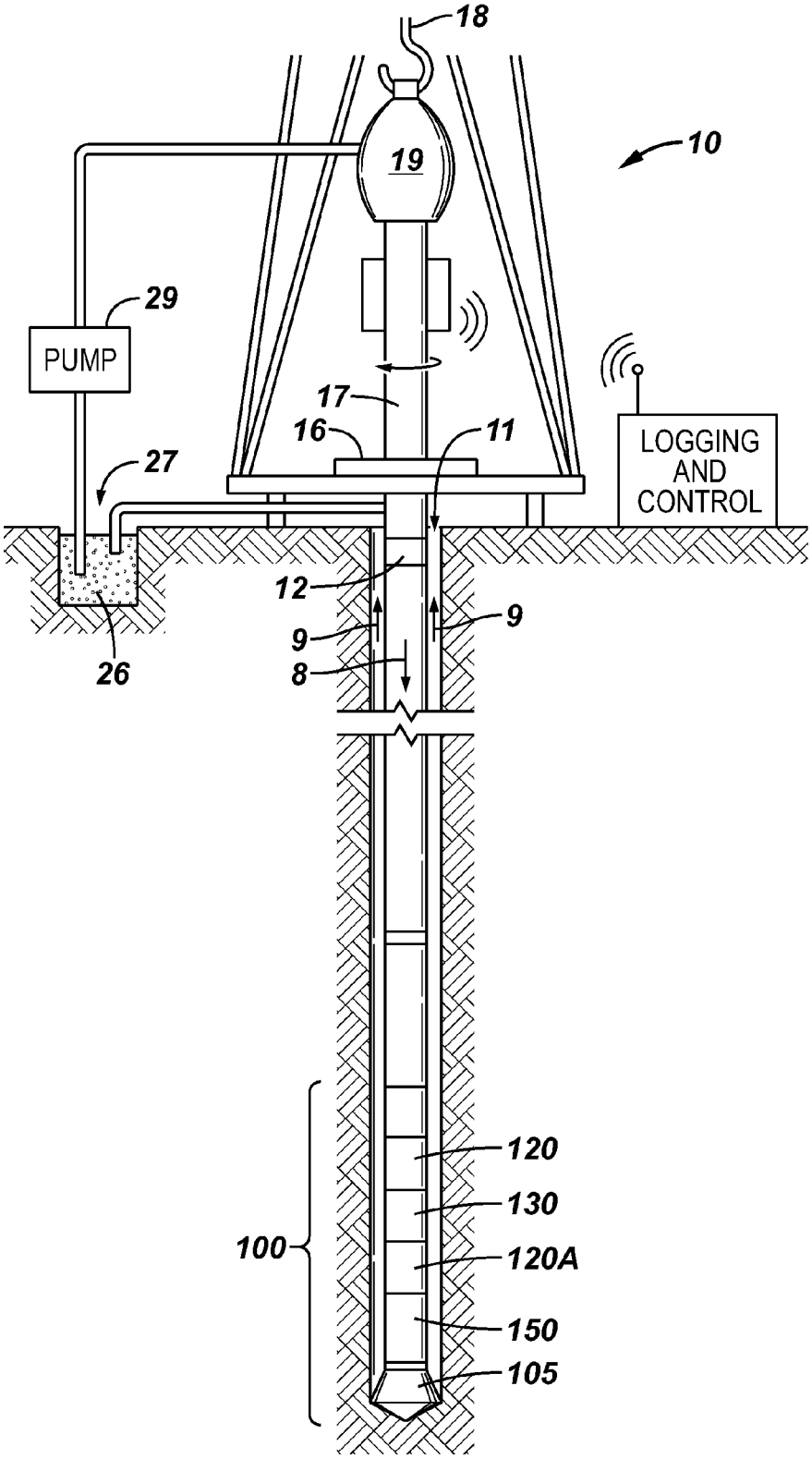
FIG. 1 is a wellsite system in which embodiments of a steerable system can be employed, according to an embodiment of the disclosure.

Referring to FIG. 1 a wellsite system is illustrated in which embodiments of the steerable system described herein can be employed. The wellsite can be onshore or offshore. In this system, a borehole 11 is formed in subsurface formations by rotary drilling and embodiments of the steerable system can be used in many types of directional drilling applications.

In the example illustrated, a drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. A top drive system could alternatively be used.

In the example of this embodiment, the surface system further comprises drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120 and a measuring-while-drilling (MWD) module 130. The bottom hole assembly 100 also may comprise a steerable system 150, and a drill bit 105. In some applications, the bottom hole assembly 100 further comprises a motor which can be used to turn the drill bit 105 or to otherwise assist the drilling operation. Additionally, the steerable system 150 may comprise a rotary steerable system to provide directional drilling.

The LWD module 120 is housed in a special type of drill collar and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module may include capabilities for measuring, processing, and storing information, as well as for communicating with the surface equipment. In the present embodiment, the LWD module includes a pressure measuring device.

The MWD module 130 may also be housed in a special type of drill collar and may contain one or more devices for measuring characteristics of the drill string and drill bit. The MWD tool may further include an apparatus (not shown) for generating electrical power to the downhole system. This may include a mud turbine generator (also known as a "mud motor") powered by the flow of the drilling fluid, it being understood that other power and/or battery systems may be employed. In the present embodiment, the MWD module may comprise a variety of measuring devices: e.g., a weight-on-bit measuring device, a torque measuring device, a vibration measuring device, a shock measuring device, a stick slip measuring device, a direction measuring device, and/or an inclination measuring device. As described in greater detail below, the steerable system 150 may also comprise instrumentation to measure desired parameters, such as weight on bit and torque on bit parameters.

The steerable system 150 can be used for straight or directional drilling to, for example, improve access to a variety of subterranean, hydrocarbon bearing reservoirs. Directional drilling is the intentional deviation of the wellbore from the path it would naturally take. In other words, directional drilling is the steering of the drill string so that it travels in a desired direction. Directional drilling does not necessarily require a tortuous wellbore. Directional drilling may be used to maintain a straight wellbore by compensating for other forces acting on the drill string.

Directional drilling is useful in offshore drilling, for example, because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operations. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

In some directional drilling applications, steerable system 150 includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Directional drilling systems for drilling boreholes into the earth may be generally classified as either "point-the-bit" systems or "push-the-bit" systems.

In a point-the-bit system, the axis of rotation of the drill bit is deviated from the local axis of the bottom hole assembly in the general direction of the new hole. In effect, the bit is "pointed" in the desired direction. The hole is propagated in accordance with the customary three-point geometry defined by upper and lower stabilizer touch points and the drill bit. The angle of deviation of the drill bit axis coupled with a finite distance between the drill bit and lower stabilizer result in curve generation. There are many ways in which this may be achieved including a fixed or adjustable bend at a point in the bottom hole assembly close to the lower stabilizer or a flexure of the drill bit drive shaft distributed between the upper and lower stabilizer. In its idealized form, the drill bit does not perform substantial sideways cutting because the bit axis is aligned in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is no specially identified mechanism to deviate the bit axis from the local bottom hole assembly axis; instead, the requisite non-collinear condition is achieved by applying an eccentric force or displacement in a direction that is preferentially orientated with respect to the direction of hole propagation. In effect, "pushing" the bit in the desired direction. Again, there are many ways in which this may be achieved, including non-rotating (with respect to the hole) eccentric stabilizers (displacement based approaches) and actuators that apply force to the drill bit in the desired steering direction. Again, steering is achieved by creating non co-linearity between the drill bit and at least two other touch points. In its idealized form, the drill bit cuts sideways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Figure 2:
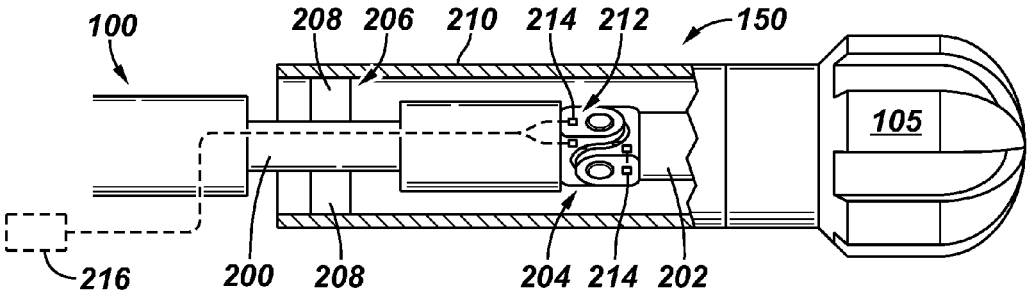
FIG. 2 is a schematic illustration of an example of an instrumented steerable system for directional drilling, according to an embodiment of the disclosure.

Referring generally to FIG. 2, a portion of bottom hole assembly 100 is illustrated as comprising steerable system 150 coupled with drill bit 105. In this embodiment, the steerable system 150 comprises a main shaft 200 coupled to an output shaft 202 by a joint 204, such as a universal joint. In a borehole drilling application, the output shaft 202 may comprise a drill bit shaft by which drill bit 105 is rotated during a drilling operation. The output shaft 202, e.g. drill bit shaft, may be pivoted with respect to main shaft 200 about universal joint 204 to enable controlled, directional drilling. An actuation system 206 may be used to maintain the desired angle between output shaft 202 and main shaft 200 during rotation of the drill bit 105 to control drilling direction.

In the example illustrated, actuation system 206 comprises a plurality of actuators 208 which may be individually controlled to maintain the desired pivot angle between output shaft 202 and main shaft 200 about the universal joint 204. As illustrated, the actuator 208 may be coupled between main shaft 200 and a surrounding housing structure 210, such as a tubing. The housing structure 210 is coupled to output shaft 202 such that radial expansion and contraction of actuators 208 causes output shaft 202 to pivot with respect to main shaft 200. However, actuators 208 may be positioned above and/or below universal joint 204. Additionally, the actuators 208 may be designed to act against a suitable housing structure 210 or against a surrounding wellbore wall depending on whether the steerable system 150 is generally in the form of a point-the-bit system, a push-the-bit system, or a hybrid system combining point-the-bit features with push-the-bit features. Any of these systems can be used in a directional drilling system to control pivoting motion of an output shaft with respect to a main shaft about the joint 204.

Furthermore, the actuators 208 may comprise a variety of controllable actuators which are selectively actuated by a corresponding control system, such as those control systems discussed in the point-the-bit and push-the-bit patents discussed above. Depending on the desired control system, the actuator 208 may comprise a hydraulic actuators, electromechanical actuators, or tool ball actuators, such as shown in US Published Patent Application No. 20100139980.

In the embodiment illustrated in FIG. 2, the steerable system 150 is combined with instrumentation in the form of a sensor system 212. The sensor system 212 comprises at least one sensor and often a plurality of sensors 214 mounted on components of steerable system 150. In many borehole drilling applications, the sensors 214 are mounted in relatively close proximity to drill bit 105. For example, sensors 214 may be mounted on universal joint 204, on main shaft 200, and/or on output shaft 202 to measure desired parameters. Examples of such parameters include longitudinally directed forces and torque related forces. In a borehole drilling system, for example, the sensors 214 may be designed and arranged to measure and monitor weight on bit and torque on bit forces. In some applications, at least a portion of the data on these parameters is relayed in real time to a suitable control system 216 which may comprise a surface control system, a downhole control system, or a control system combining surface components and downhole components. In other systems, at least a portion of the data on these parameters may be recorded downhole and reviewed later. In other systems, a portion of the data may be transmitted by an acceptable telemetry system (such as, by way of example only, mud pulse telemetry or wired drill pipe or wireless telemetry or any combination of acceptable telemetry systems) and a portion of the data may be recorded for later review. Parameters such as weight on bit and torque on bit can be measured with sensors 214 in the form of strain gauges or other suitable force measuring sensors.

Figure 3:
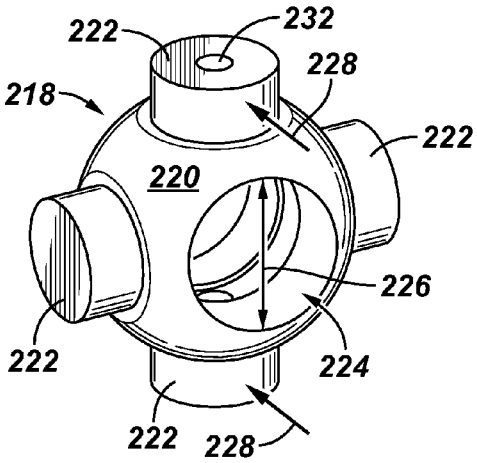
FIG. 3 is a view of an example of a cross member used in a universal joint which connects components of the steerable system, according to an embodiment of the disclosure.
Figure 4:
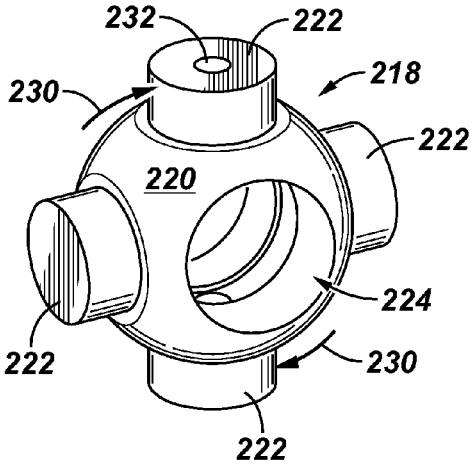
FIG. 4 is another illustration of the cross member illustrated in FIG. 3 showing forces acting on the cross member in a different direction, according to an embodiment of the disclosure.

The weight on bit and torque on bit forces act on joint 204 during the drilling operation. If joint 204 is in the form of a universal joint, the joint may utilize a cross member 218 as illustrated in FIGS. 3 and 4. By way of example, cross member 218 may comprise a central structure 220 from which extends a plurality of hinge pins 222, e.g. four hinge pins 222. The hinge pins 222 are the features which pivotably engage the main shaft 200 and the output shaft 202. Typically, two of the hinge pins 222 engage the main shaft 200 and two of the hinge pins 222 engage the output shaft 202. The central structure 220 also may comprise a through passage 224 having an inner diameter 226. The through passage 224 may be used, for example, to allow flow of drilling mud down through steerable system 150 to drill bit 105. In FIG. 3, the longitudinally directed forces acting on joint 204 as a result of weight on the bit are illustrated by arrows 228. Similarly, the torque forces acting on joint 204 as a result of torque on the bit are illustrated by arrows 230 in FIG. 4. The weight on bit forces 228 and the torque on bit forces 230 are two physical loads transmitted from the drill bit 105 to the tool string 12, and vice versa, through the cross member 218.

Referring generally to FIGS. 5 and 6, examples of sensor system 212 and sensors 214 are illustrated as combined with the cross member 218 which has been illustrated in cross-section. Either of these examples provides an instrumented cross member 218 which is able to provide direct measurement of the weight on bit and the torque on bit. In these embodiments, holes 232 have been formed in at least one of the hinge pins 222, e.g., two of the hinge pins 222. By way of example, the holes 232 may be drilled or otherwise formed in an axial direction into or through the corresponding hinge pins 222. In some embodiments, the holes 232 are formed through the corresponding hinge pins 222 until meeting a locally increased inside diameter of through passage 224 to provide enhanced sensitivity of measurement.

As illustrated in FIG. 5, sensors 214, e.g., strain gauges, may be located within holes 232 against internal surfaces of the holes 232. The sensors 214 may be oriented to detect and measure the desired parameter, such as weight on bit and/or torque on bit. By way of example, the sensor system 212 may comprise two shear strain gauges 214 placed perpendicularly with respect to the direction of the axial load to detect weight on bit. In this example, one sensor 214 may be placed in each of two holes 232 at a desired distance from an outer end of the hinge pin 222, e.g., 10 to 20 mm. The sensor system 212 also may comprise two axial strain gauges placed radially and perpendicular with respect to the direction of the axial load. The sensors 214 may again be positioned with one sensor 214 in each of two holes 232, and with each sensor 214 located at the desired distance from an end of the hinge pin 222. Referring generally to FIG. 6, suitable strain gauges 214, e.g., shear strain gauges, also can be placed along the surface forming inner diameter 226 to measure weight on bit.

Torque on bit can be measured in a similar manner. For example, torque on bit can be measured by torque on bit sensors in the form of two shear strain gauges 214 placed perpendicular in a plane at 45° to the direction of the load to detect the torque on bit. In this example, one sensor 214 may be placed in each of two holes 232 at a desired distance from an outer end of the hinge pin 222, e.g., 10 to 20 mm. The sensor system 212 also may detect torque on bit by orienting two axial strain gauges 214 radially and perpendicular with respect to the direction of the torque load. In this example, one sensor 214 is again placed in each of two holes 232 and at the desired distance from an end of the hinge pin 222. Referring again to FIG. 6, suitable strain gauges 214, e.g., axial strain gauges, also can be placed radially in between the hinge pins 222, e.g., along the surface forming inner diameter 226.

The sensors 214 may be positioned at a variety of locations and in a variety of orientations to provide the desired instrumentation and parameter detection. For example, different positioning and localization of strain gauges can determine their sensitivity and also the cross reading or influence of loading on a specifically designed instrumentation system. A summary of strain measurements from the sensors and an estimation of cross readings from sensors on the cross member due to combined effects has been presented in the table of FIG. 7. As illustrated by the table, high sensitivity of measurement is possible. By combining different strain gauge placements, high sensitivity of the strain measurements can be achieved with very limited cross reading in the measurement.

Figure 8:
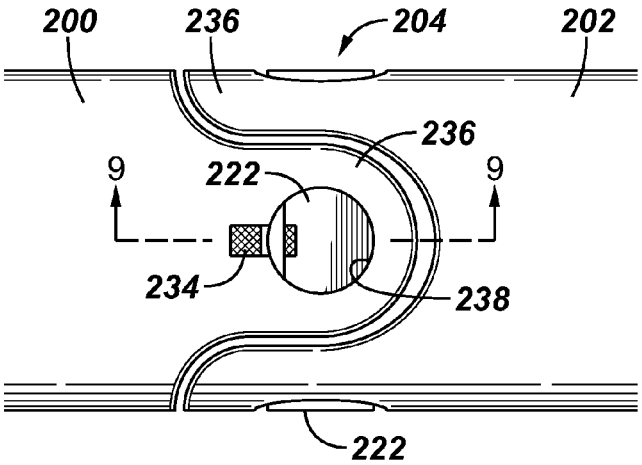
FIG. 8 is a schematic illustration of a main shaft coupled to an output shaft by the universal joint combined with instrumentation, according to an embodiment of the disclosure.
Figure 9:
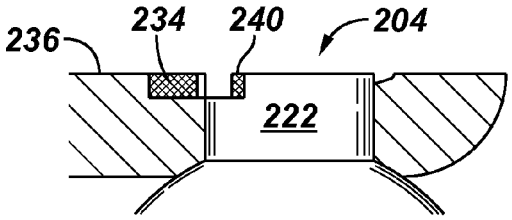
FIG. 9 is a cross-sectional view taken generally along line 9-9 of FIG. 8, according to an embodiment of the disclosure.

Referring generally to FIGS. 8 and 9, an illustration is provided of additional instrumentation. By way of example, sensor system 212 also may comprise an angular displacement sensor or sensors 234. The angular displacement sensor 234 can be mounted adjacent a hinge pin 222, for example, to detect relative movement, e.g., rotation, of the hinge pin 222 with respect to a lug 236 of the main shaft 200 and/or the output shaft 202. The engagement ends of the main shaft 200 and the output shaft 202 have pairs of lugs 236 with openings 238 designed to pivotably engage corresponding hinge pins 222. In the example illustrated in FIGS. 8 and 9, the angular displacement sensor 234 is mounted in one of these lugs 236 to detect relative movement with respect to the corresponding hinge pin 222.

Figure 10:
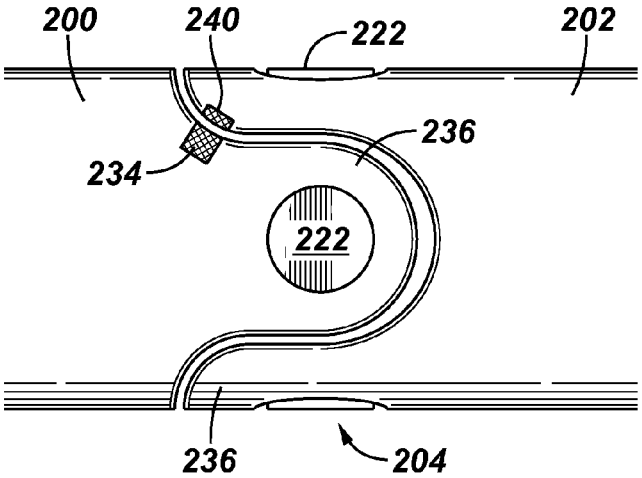
FIG. 10 is a schematic illustration of a main shaft coupled to an output shaft by the universal joint combined with instrumentation in another type of arrangement, according to an embodiment of the disclosure.

The angular displacement sensor or sensors 234 may be used to determine and monitor the tilt angle of the output shaft 202, e.g. bit shaft, with respect to the main shaft 200. However, the sensors 234 also may be used to correct the measurement of the weight on bit and/or the torque on bit monitored by 214. In some applications, the angular displacement measurement is performed by angular displacement sensors 234 mounted in tandem on, for example, the main shaft 200. The tandem sensors 234 are located in a position for monitoring the distance of a target 240 placed on the cross member 218. As the cross member 218 rotates with respect to the main shaft 200, the relative displacement between the sensor 234 and the target 240 evolves as a function of the sinus of the rotation angle. As illustrated in the embodiment of FIG. 10, the angular displacement sensor 234 also may be located at other positions. In this latter example, sensor 234 is positioned on main shaft 200 to monitor target 240 positioned on output shaft 202.

Figure 11:
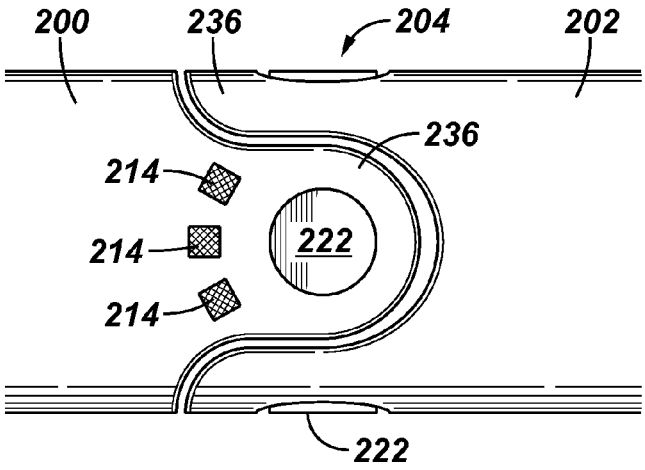
FIG. 11 is a schematic illustration of a main shaft coupled to an output shaft by the universal joint combined with instrumentation in another type of arrangement, according to an embodiment of the disclosure.

Referring generally to FIG. 11, the weight on bit and the torque on bit sensors 214 may be located at other positions along steerable system 150, e.g., rotary steerable system. For example, the weight on bit sensors 214 may comprise axial strain gauges mounted on two or more lugs 236. In FIG. 11, the weight on bit sensor 214 is the centrally located sensor relative to the other sensors. In this example, the torque on bit sensors 214 comprise shear strain gauges which can be placed on both sides of the weight on bit sensor 214, as illustrated in FIG. 11. In another embodiment, the torque on bit sensors 214 can be placed on one side of the weight on bit sensor and oriented at an angle with respect to the weight on bit sensor 214. It should be noted that the weight on bit sensors 214 and the torque on bit sensors 214 may be placed on either the main shaft 200 or the output shaft 202.

Figure 12:
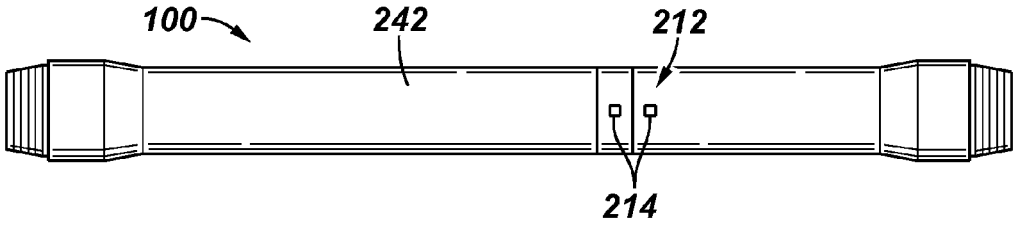
FIG. 12 is a schematic illustration showing instrumentation combined with a flex tube of the steerable system, according to an embodiment of the disclosure.

In FIG. 12, another embodiment of sensor system 212 is illustrated. In this embodiment, the bottom hole assembly 100 comprises a flex tube 242 which is instrumented by sensor system 212. The flex tube 242 is designed to flex as the steerable system 150 is controlled so as to change the direction of drilling. By placing sensors 214 on a flex tube 242, the amount of deflection of flex tube 242 can be measured. This deflection measurement may be used to derive a real time bent angle. The bent angle and the direction of the main shaft 200 can be used to determine the position of the drill bit 105 in comparison to the main shaft 200 or the overall tool string 12.

By way of example, the embodiment illustrated in FIG. 12 may utilize sensors 214 arranged in the form of two full bridges which are placed at 90° with respect to each other. The bridges may comprise axial strain gauges which are glued or otherwise attached on, for example, the outside diameter of the flex tube 242. Assuming a sufficient pretention of shaft 200, the stress level in flex tube 242 decreases when applying weight-on-bit. If the strain measurement is properly calibrated for pressure and temperature, the measurement of the weight on bit can be deduced from the level of stresses remaining in the flex tube 242. The axial strain measurements may be determined by averaging the axial strain gauge measurements at 180°.

Figure 13:
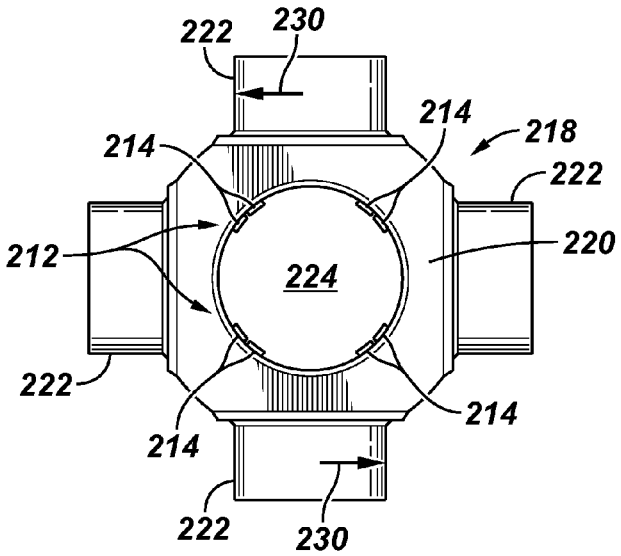
FIG. 13 is a view of another example of a cross member used in a universal joint which connects components of the steerable system, according to an embodiment of the disclosure.
Figure 14:
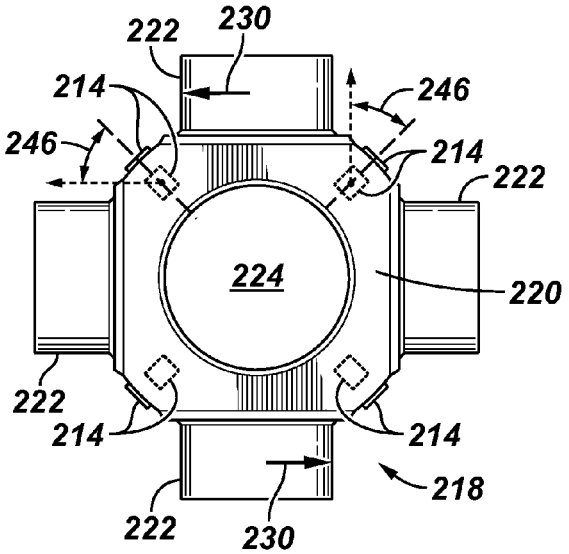
FIG. 14 is a view of another example of a cross member used in a universal joint which connects components of the steerable system, according to an embodiment of the disclosure.
Figure 15:
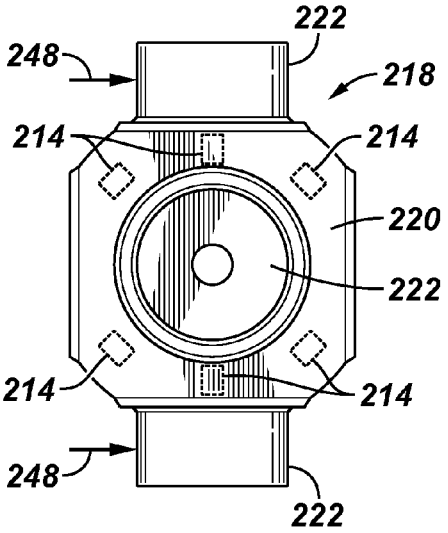
FIG. 15 is another illustration of the cross member illustrated in FIG. 14 showing forces acting on the cross member in a lateral direction, according to an embodiment of the disclosure.

The sensors 214 may be arranged in bridges, e.g., two full bridges placed at 90° with respect to each other, for a variety of drilling and instrumentation applications. Referring to FIGS. 13-15, other embodiments of sensors 214 and sensor system 212 are illustrated. The location and placement of the sensors has been selected to, for example, minimize crosstalk between the measurements versus a specific load case. For example, the effects of axial loading on the torque on bit measurements can be minimized and vice versa.

In the embodiment illustrated in FIG. 13, for example, the plurality of sensors 214 is arranged in pairs with each pair of sensors disposed at approximately 90° with respect to the next sequential pair of sensors. In this embodiment, the sensors are arranged in a recess 244, such as a circumferential recess disposed along the interior through passage 224 of the central structure 220 of cross member 218.

Another embodiment is illustrated in FIGS. 14 and 15 in which a plurality of sensors 214, e.g., strain sensors, is arranged such that the sensors are spaced 90° apart from each other. Additionally, at least some of the sensors 214 are oriented at 45° with respect to the axes of hinge pins 222, as indicated by angles 246. The arrangement of sensors 214 enables detection and monitoring of weight on bit and torque on bit as discussed above. However, the arrangement also enables detection and monitoring of lateral forces acting on the cross member 218, as indicated by arrows 248 in FIG. 15. These embodiments provide a few examples of sensor arrangements which may be used to detect the various force loads in many types of drilling applications.

Depending on the drilling application, the bottom hole assembly and the overall drilling system may comprise a variety of components and arrangements of components. Additionally, the instrumentation system may comprise many different types of sensors and arrangements of sensors depending on the specific parameters to be monitored. The instrumentation system may be coupled with a variety of control systems 216, such as processor-based control systems which are able to evaluate the sensor data and output information and/or control signals. In some embodiments, the control system may be programmed to automatically adjust the drilling direction based on programmed instructions. Additionally, a variety of rotary steerable systems and other steerable systems may be used to facilitate the directional drilling. Also, universal joints and other types of joints may be used to provide the flexure point between the main shaft and the output shaft.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for drilling, comprising:

a rotary steerable system having a main shaft coupled to a drill bit shaft by a universal joint, wherein the rotary steerable system further comprises an actuation system to pivot the drill bit shaft about the universal joint with respect to the main shaft; and a sensor system mounted on the rotary steerable system, the sensor system having a plurality of sensors positioned to measure both weight on bit and torque on bit during a wellbore drilling operation, at least one sensor of the plurality of sensors being mounted within the universal joint to provide a direct measurement of forces acting on universal joint.

2. The system as recited in claim 1, wherein the plurality of sensors comprises a plurality of strain sensors.

3. The system as recited in claim 1, wherein the plurality of sensors comprises sensors mounted on at least one lug coupled to the universal joint.

4. A method for drilling, comprising:

detecting weight on bit with weight on bit sensors mounted on a rotary steerable system having a universal joint to facilitate directional drilling;

measuring torque on bit with torque on bit sensors mounted on the universal joint of the rotary steerable system to provide a direct measurement of torque acting on the universal joint;

wherein detecting and measuring comprises detecting and measuring with at least some of the weight on bit sensors and the torque on bit sensors mounted on a rotatable shaft coupled to the universal joint;

outputting data from the weight on bit sensors and the torque on bit sensors to a control system; and monitoring the data during a wellbore drilling operation.

5. The method as recited in claim 4, further comprising compensating for downhole pressure and temperature effects.

6. The method as recited in claim 4, further comprising sensing the tilt angle of the rotary steerable system in real-time.

7. A method for detecting force loads, comprising:

coupling a main shaft to an output shaft via a universal joint;

controlling the pivoting of the output shaft relative to the main shaft about the universal joint;

mounting a plurality of sensors on at least one of the main shaft, the output shaft, and the universal joint;

orienting the plurality of sensors to detect and monitor both axial loading and torque loading in the universal joint; and mounting the main shaft, the output shaft, and the universal joint into a rotary steerable system of a wellbore drilling system, wherein the rotary steerable system comprises an actuation system to pivot the output shaft about the universal joint with respect to the main shaft.

8. The method as recited in claim 7, wherein orienting further comprises orienting the plurality of sensors to detect and monitor lateral loading on the universal joint.

* * * * *